US005288603A

United States Patent [19]

Maskasky et al.

[11] Patent Number: 5,288,603

[45] Date of Patent: Feb. 22, 1994

[54] HIGH CHLORIDE SILVER IODOHALIDE EMULSIONS CONTAINING AN INCREASED PROPORTION OF IODIDE

[75] Inventors: Joe E. Maskasky; Carlos A. Reyes; Martin McMillan, all of Rochester, N.Y.

[73] Assignee: Eastman Kodak Company, Rochester, N.Y.

[21] Appl. No.: 649,511

[22] Filed: Feb. 1, 1991

[51] Int. Cl.[5] ..... G03C 1/005

[52] U.S. Cl. ..... 430/567; 430/569

[58] Field of Search ..... 430/567, 569; 420/567, 420/569

[56] References Cited

U.S. PATENT DOCUMENTS

| | | | |
|---|---|---|---|
| 4,094,648 | 6/1978 | Maskasky | 430/567 |
| 4,184,878 | 1/1980 | Maternaghan | 430/567 |
| 4,339,532 | 7/1982 | Conben et al. | 430/567 |
| 4,591,549 | 5/1982 | Matsuzaka et al. | 430/567 |

FOREIGN PATENT DOCUMENTS

| | | |
|---|---|---|
| 505012 | 8/1930 | Fed. Rep. of Germany . |
| 522766 | 4/1931 | Fed. Rep. of Germany . |
| 2328868 | 6/1973 | Fed. Rep. of Germany . |

OTHER PUBLICATIONS

Phillips, "An Introduction to Crystallography", 4th ed., Longman 1971 reprinted 1981, pp. 8-9, 51-61.

Castellan, "Physical Chemistry" Addison-Wesley Publishing Co. 1964, pp. 291-317.

James, *The Theory of Photographic Process*, 4th Ed., Macmillan (1977) pp. 1-5.

H. Hirsch, "Photographic Emulsion Grains with Cores: Part I, Evidence for the . . ." J. of Photog. Science, vol. 10 (1962), pp. 129-134.

H. Chateau, *Comptes Rendus Academie Des Sciences Paris*, 249, 1959, pp. 1887-1889.

Cornwwell & Dyson, "Thermoelectric Properties of the Molten Silver Chloride-Silver Iodide Eutectic Mixture", Brit. J. Appl. Phys. (J. Phys. D), 1969, ser. 2. vol. 2. pp. 305-307.

Groznetskii, Zhuraviev, Kitaev & Zhukova, "Thermal Analysis of the AgCl-AgI and AgBr-AgI Systems", Russion Journal of Inorganic Chemistry, vol. 33 (3), 1988. pp. 399 & 400.

*Primary Examiner*—Charles L. Bowers, Jr.
*Assistant Examiner*—Thorl Chea
*Attorney, Agent, or Firm*—Peter C. Cody

[57] ABSTRACT

A photographic silver halide emulsion comprised of a high chloride silver iodohalide grain structure in which the proportion of iodide has been increased.

9 Claims, 2 Drawing Sheets

HIGH CHLORIDE SILVER IODOHALIDE EMULSIONS CONTAINING AN INCREASED PROPORTION OF IODIDE

FIELD OF THE INVENTION

The invention is directed to silver halide photography. More specifically, the invention is directed to a novel silver halide emulsion for use in photography.

BACKGROUND OF THE INVENTION

Photographic silver halide emulsions contain radiation-sensitive microcrystals, commonly referred to as grains. Radiation-sensitive grains which consist essentially of silver iodide, bromide or chloride, with no other halide being present are each known. Radiation-sensitive grains containing mixtures of halides in their crystal structure are also known. However, the range of halide combinations that can exist within a crystal structure is limited, since silver iodide favors different crystal habits than that of silver bromide or chloride.

Figure 1:
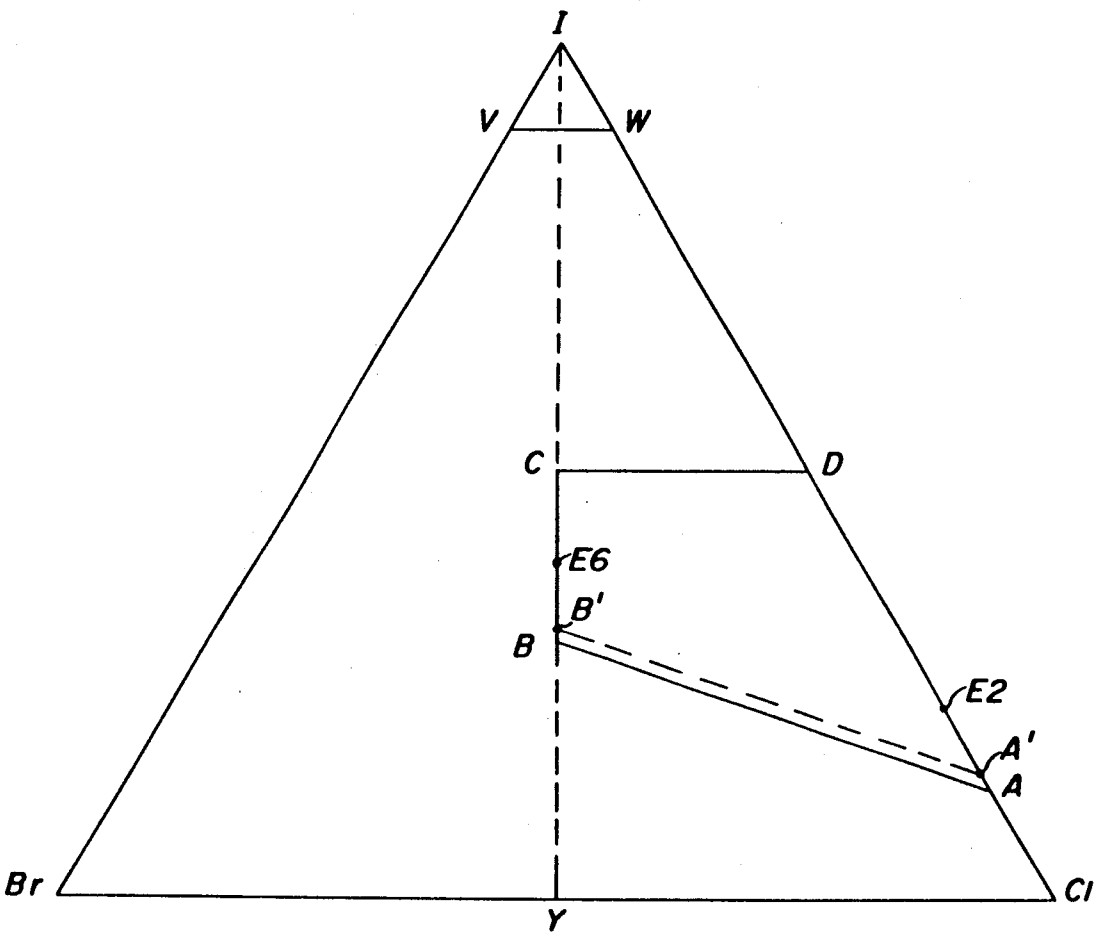
FIG. 1 is a matrix graphically illustrating all possible choices of any one or combination of chloride, bromide and iodide ions to satisfy a total halide requirement.

The range of conceivable combinations of iodide, bromide and chloride in a silver halide crystal structure as compared to those that can be realized is most readily visualized by reference to FIG. 1, which is a matrix encompassing all proportions of these three halides. Considering first only the extremes, at points I, Br and Cl 100% of the total halide is accounted for by the indicated halide. Along axis Cl-Br 0% of the total halide is accounted for by iodide. Along axis I-Cl 0% of the total halide is accounted for by bromide. Along axis Br-I 0% of the total halide is accounted for by chloride. At all other intermediate locations in the matrix a mixture of chloride, bromide and iodide is present, the concentration of each halide at any selected intermediate point being determined by the spacing of the intermediate point from the matrix 100% point and the 0% axis for that halide.

Silver chloride and silver bromide each form a face centered cubic rock salt type crystal lattice structure. These crystal structures are known which consist of silver ions and (a) bromide ions as the sole halide ions, (b) chloride ions as the sole halide ions, or (c) mixtures of chloride and bromide ions in all proportions. Thus, all possible combinations along the Br-Cl axis in FIG. 1 are known in silver halide grain structures. The crystal structures differ solely by their unit cell dimensions, which are a reflection of the differing sizes of chloride and bromide ions. Measurements of crystal lattice parameters are an accepted method of determining the ratio of halides present.

Silver iodide exhibits a face centered cubic rock salt crystal structure, but only at very high pressure levels (3,000 to 4,000 times atmospheric pressure). This form of silver iodide, referred to as $\sigma$ phase silver iodide, has no relevance to silver halide photography. A silver iodide crystal structure that is stable under ambient conditions is the hexagonal wurtzite type, commonly referred to as $\beta$ phase silver iodide. Another crystal structure of silver iodide sufficiently stable to be usable at room temperature is the face centered cubic zinc blend type, commonly referred to as $\gamma$ phase silver iodide. Silver iodide emulsions have been prepared containing each of $\beta$ phase and $\gamma$ phase crystal structures. A fourth crystallographic form of silver iodide is $\alpha$ phase, a body centered cubic crystal structure which is stated by James, *The Theory of Photographic Process*, 4th Ed., Macmillan (1977), page 1, to require a temperature of 146° C. for its formation. (James, pp. 1–5, are relevant to this and following portions of this discussion.)

In considering mixtures of bromide and/or chloride ions with iodide ions in a silver halide grain crystal structure, there are two possible conditions to consider: (1) how much bromide and/or chloride ion can be tolerated in a silver iodide crystal structure and (2) how much iodide ion can be tolerated in a silver bromide and/or chloride crystal structure. Emulsions satisfying (1) are typically referred to as "high iodide" silver halide emulsions, where the iodide content is typically stated to be at least 90 mole percent, based on total silver. Maternaghan U.S. Pat. No. 4,184,878 is illustrative of a high iodide silver halide emulsion. Since silver iodide emulsions have found limited photographic utility, very limited investigation of bromide and/or chloride ion containing variations have occurred. It is generally believed, however, that the silver iodide crystal structure will not tolerate the incorporation of more than 10 mole percent of bromide and/or chloride ion before the halides partition themselves in different phases. Referring to FIG. 1, high iodide silver halide crystal structures exist within the area defined by points W, V and I.

The overwhelming majority of iodide containing emulsions satisfy condition (2). The most extensively used photographic emulsions are silver iodobromide emulsions. All references to composite halide emulsions, grains and crystal structures follow the convention (refer to James, cited above, page 4) of naming the halides in their ascending order of concentration.

The silver bromide crystal structure can tolerate less than equal amounts of iodide. The maximum amount of iodide incorporated in silver bromide is 46.5 mole percent reported by H. Hirsch, "Photographic Emulsion Grains with Cores: Part I. Evidence for the Presence of Cores", J. of Photog. Science, Vol. 10 (1962) pp. 129–134.

Since chloride ions are considerably smaller than bromide ions, the size disparity between chloride ions and iodide ions is much greater than that between bromide ions and iodide ions. It is therefore not surprising that lesser amounts of iodide ions can be tolerated in a silver chloride crystal structure than in a silver bromide crystal structure. Silver iodochloride emulsions are known. Investigation has revealed that the upper limit (demonstrated in the Examples below) of iodide incorporation in a silver chloride crystal structure is 13 mole percent, based on total silver, using conventional emulsion preparation techniques. Referring to FIG. 1, the iodide range limits of conventional silver iodochloride emulsions along axis I-Cl are defined by points Cl (0 mole % I) and A (13 mole % I).

Each halide ion selection is known to impart particular photographic advantages. although known and used for many years for selected photographic applications, the more rapid developability and the ecological advantages of high chloride silver iodohalide emulsions have provided an impetus for employing these emulsions over a broader range of photographic applications. As employed herein the term "high chloride silver iodohalide" as applied to emulsions, grains and crystal structures is herein defined to require that the concentration of the halide ions other than iodide ions exceed or at least equal the concentration of iodide ions and that the concentration of chloride ions exceed or at least equal the concentration of bromide ions. High chloride iodohalides include silver iodochlorides, iodochlorobromides and bromoiodochlorides. Referring to FIG. 1, all of the silver halide compositions in the area bounded by points C1, Y, C and D satisfy the high chloride silver iodohalide definition.

In considering the possibility of substituting chloride ion as the halide of choice for bromide ion in silver halide photography the problem of iodide incorporation arises. The overwhelming majority of photographic emulsions contain iodide to improve their photographic properties. Conventional high chloride silver iodohalide grain structures are limited to the compositions permitted within the area defined in FIG. 1 by points C1, Y, B and A, and this limits iodide concentrations in high chloride iodohalides to maximum levels well below maximum levels attainable in silver iodobromide and iodochlorobromide grain structures. The iodide concentrations in high chloride iodohalide emulsions are particularly limited where bromide ion concentrations are less than 20 mole percent. In some of the largest product volume photographic applications for silver iodobromide emulsions, such as those in which the grains contain increased iodide levels for improved speed-granularity relationships or enhanced interimage effects, substitution of chloride ions for bromide ions is not possible, since no high chloride iodohalide emulsion is available that can tolerate comparable iodide ion inclusion levels within the crystal structure of the grains.

Although the comparative Example provided below establishes 13 mole percent iodide based on total silver to be a concentration maximum iodide in silver chloroiodide, a number of published studies of phase boundaries of silver halides suggest even lower iodide limits. The following teachings are considered representative:

H. Chateau, *Comptes Rendus Academie Des Sciences Paris*, 249, 1959, pp. 1887–89, found an iodide content in silver chloroiodide of 9.3 percent, as compared to a predicted value of 7.5 percent.

K. Cornwell and R. W. Dyson, "Thermoelectric Properties of the Molten Silver Chloride-Silver Iodide Eutectic Mixture", Brit. J. Appl. Phys. (J. Phys. D), 1969, ser. 2, vol. 2, pp. 305–07, presents a phase diagram showing the concentration of silver iodide in silver chloride to be just about 10 mole percent.

V. V. Groznetskii, V. D. Zhuraviev, G. A. Kitaev and L. V. Zhukova, "Thermal Analysis of the AgCl-AgI and AgBr-AgI Systems", Russian Journal of Inorganic Chemistry, vol. 33 (3), 1988, pp. 399 and 400, reports a similar phase diagram to that of Cornwell et al, but suggests an even lower concentration limit of silver iodide in silver chloride.

SUMMARY OF THE INVENTION

It is an object of this invention to make available photographic emulsions containing high chloride silver iodohalide grain structures in which the proportion of iodide is increased above levels that have heretofore been attainable by conventional emulsion preparation techniques.

In one aspect this invention is directed to a photographic silver halide emulsion comprised of a high chloride silver iodohalide grain structure in which the proportions of chloride, bromide and iodide ions are chosen to lie within the boundary defined by A, B, C and D in FIG. 1.

DESCRIPTION OF PREFERRED EMBODIMENTS

The B-A axis in FIG. 1 defines the upper limit of iodide incorporation in a high chloride silver iodohalide crystal structure prepared by conventional photographic emulsion preparation techniques. These limits were confirmed by emulsion preparations included in the Examples below for purposes of comparison. The highest iodide incorporation level achieved in a silver iodochloride emulsion prepared for purposes of comparison (see Example 1) was 12.8 mole percent, based on total silver. This silver iodochloride composition is located in FIG. 1 on the I-Cl axis just below point A, which lies at an iodide level of 13 mole percent. The highest iodide incorporation level achieved in a silver iodohalide emulsion containing equal molar amounts chloride and bromide ions prepared for purposes of comparison (see Example 4) was 27.3 mole percent, based on total silver. This composition is located in FIG. 1 just below point B, which lies at an iodide level of 28 mole percent. The axis B-A lies just above the upper iodide concentration limit in conventional high chloride silver iodohalide grain structures.

The present invention is directed to photographic silver halide emulsions comprised of a high chloride silver iodohalide grain structure in which the proportions of chloride, bromide and iodide ions are chosen to lie within the boundary defined by A, B, C and D in FIG. 1. That is, the high chloride silver iodohalide grains structures provided by this invention contain iodide concentrations above the maximum iodide incorporation levels in conventional high chloride iodohalide emulsion grain structure. In one preferred form, further set apart in iodide levels from conventional grain structures, the high chloride iodohalide grain structures exhibit the proportions of chloride, bromide and iodide ions that lie within the boundary defined by A', B', C and D in FIG. 1, where A' and B' require a 1 mole percent (optimally 2 mole percent) higher iodide concentration than A and B, respectively.

The discovery of how to increase the iodide concentration of a high chloride iodohalide grain structure arose from postulating that the limits of iodide incorporation under conventional emulsion preparation conditions were the result of iodide reaching its saturation limit in the face centered cubic crystal lattice. It was then proposed that the iodide concentration could be increased if (1) conditions could be found that would permit the iodide saturation limit to be increased and (2) the excess iodide incorporated under these conditions did not separate out of the face centered cubic crystal structure upon return of the emulsion so produced to ambient conditions of handling and use. Whether condition (2) could be satisfied remained, of course, entirely speculative until an emulsion preparation satisfying condition (1) had been devised and demonstrated.

In considering how a higher silver iodide saturation level could be created in a face centered cubic crystal structure the problem was confronted that photographic silver iodohalide emulsions are prepared by running an aqueous silver salt into an aqueous dispersing medium which usually contains an organic hydrophilic colloid peptizer. Since the silver iodohalide grains formed during precipitation must remain dispersed, precipitation is necessarily limited to temperatures compatible with retaining a liquid phase dispersing medium. Because of the increasingly high vapor pressure of water on heating, a temperature of 90° C. constitutes an accepted practical upper limit for the preparation of silver halide emulsions in a well controlled and reproducible manner. Even if an emulsion preparation temperature could be increased to 100° C., the boiling point of water, iodide level extrapolations from workable temperatures suggested no significant increase in iodide levels.

A preparation procedure was therefore proposed that departed entirely from conventional photographic emulsion preparation techniques. It was proposed to use elevated pressures in combination with emulsion preparation temperatures above 130° C. It was postulated that elevated pressures alone would be ineffective and such elevated temperatures would be unattainable in the absence of an elevated pressure.

To achieve a temperature above 130° C. in preparing silver iodohalide emulsions a procedure was devised whereby (a) a high chloride silver halide emulsion lacking iodide and (b) a silver iodide emulsion having a mean size of less than 0.05 μm were prepared separately. Emulsions (a) and (b) were then blended, subjected to a pressure chosen to allow the blended emulsion to be heated above 130° C. without boiling, and allowed to Ostwald ripen under these conditions, resulting in high chloride silver iodohalide grains being formed containing elevated iodide levels. In an alternative preparation approach all of the halide can be concurrently precipitated to produced a mixture of silver halide phases. This eliminates the blending step and achieves the result similar to that described above when heat and pressure are applied. It is specifically contemplated to apply heat and pressure to the emulsions while they are being transported. Thus, the emulsions of the invention are amenable to continuous preparation procedures.

In demonstrating the feasibility of the preparation process described above to increase the iodide content of a silver iodochloride emulsion shown as E2 in FIG. 1 (Example 2 below) was prepared containing 22.1 mole percent iodide, based on total silver. This represented an increase of 10 mole percent over the control iodochloride emulsion located just below point A on the I-Cl axis in FIG. 1 (Example 1 below). In other words the iodide concentration in the silver iodochloride emulsion was increased 77 percent, based on point A. At equal molar concentrations of bromide and chloride ion, iodide incorporation levels were increased from 27.3 mole percent (below point B, FIG. 1) to 39.6 mole percent, based on silver, as shown at point E6 in FIG. 1 (Example 6 below). This was an iodide concentration increase of 45 percent.

The high chloride silver iodohalide emulsions satisfying the requirements of this invention are viewed as proof that incorporation of silver iodide into a high chloride face centered cubic crystal lattice grain structure can be enhanced by undertaking incorporation under conditions of elevated temperature and pressure. While the investigations undertaken to date demonstrate the feasibility of the approach to achieving high chloride iodohalide emulsions with increased iodide contents, they have provided no indication of any upper iodide incorporation limit. The reason for this is that investigations reported have had as their purpose to demonstrate feasibility rather than to optimize the preparation process. The preparation process was chosen as the simplest available approach for achieving grain growth at elevated temperatures and pressures. If the preparation process of the invention were modified so that silver halide was formed in situ from soluble halide and silver salts (analogous to the procedures used in batch single-jet and batch or continuous double-jet precipitations), silver iodide incorporation into the rock salt type face centered cubic crystal lattice host would be increased. Increasing precipitation temperatures and selecting peptizers specifically for enhanced thermal stability are other parameters considered capable of enhancing iodide incorporation levels.

Apart from the features specifically described as being essential to the practice of the invention, the high chloride iodohalide emulsions and the processes of their preparation are compatible with conventional emulsions and processes for their preparation. Attention is directed to *Research Disclosure*, Vol. 308, December 1989, Item 308,119, particularly Section I, Emulsion preparation and types and Section IX, Vehicles and vehicle extenders, the disclosure of which is here incorporated by reference. *Research Disclosure* is published by Kenneth Mason Publications, Ltd., Dudley Annex, 21a North Street, Emsworth, Hampshire P010 7DQ, England.

In the simplest form of the invention the novel grain structure of the invention is found in the majority if not each of the grains of an emulsion and extends more or less uniformly throughout each grain. However, it is recognized that the novel grain structure can alternatively form only a portion of a grain. For example, the novel grain structure can be formed in only a core or only a shell region of a grain. Additionally, it is recognized that it is common practice to blend emulsions of differing grain populations to tailor emulsions to specific photographic populations.

EXAMPLES

The invention can be better appreciated by reference to the following specific examples.

All x-ray powder diffraction patterns of the emulsions were made using $CuK_B$ radiation. Silicon powder was added to the emulsion sample so that the values of $2\theta$ could be corrected using an internal standard.

For a two component silver halide phase at room temperature (25° C.) the following equations can be used to calculate the cubic crystal lattice constant, a, needed to determine the halide composition from X-ray diffraction data:

$$a(BrCl)=5.5502+0.002246[Br]$$

$$a(ICl)=5.5502+0.00635[I]$$

$$a(IBr)=5.7748+0.00363[I]$$

where [Br] and [I] represent the concentrations of bromide and iodide, respectively, in mole percent. These equations appear in James, cited above, p. 4.

From these equations the following equation for a three component silver halide phase was derived:

$$a(\mathrm{IBrCl}) = a(\mathrm{BrCl}) + \frac{6.0844 - a(\mathrm{BrCl})}{84.12} \quad [\mathrm{I}]$$

where a(IBrCl) is the lattice constant of the AgIBrCl phase at room temperature and a(BrCl) is the lattice constant of an AgBrCl phase of the same Br to Cl ratio as the AgIBrCl phase, but lacking the iodide component.

EXAMPLE 1

Below Point A, FIG. 1

This example is a control. It illustrates that only 12.8 mole % iodide can be incorporated in AgICl emulsion grains precipitated at 90° C.

To a stirred reaction vessel containing 400 ml of a solution 7.5% in bone gelatin and 0.1M in NaCl at 90° C. were added a solution 2.5M in $AgNO_3$ at 1 ml/min and a solution 2.025M in NaCl and 0.575M in NaI at a rate needed to maintain a pAg of 6.6. After 5 minutes, the rate of silver addition was linearly accelerated to 5.3 ml/min in 30 minutes. The total silver consumed was 0.25 mole.

If a single homogeneous phase had formed, it would be AgICl containing 23 mole % iodide. The x-ray powder diffraction pattern of the final emulsion showed the AgICl {425} reflection was centered at $2\theta=67.12°$ which calculates, from the equation given for a(ICl) given above, to be 12.8% in dissolved iodide. In addition, reflections attributed to free AgI were also observed.

EXAMPLES 2 AND 3

These two examples illustrate that the level of dissolved iodide in AgICI emulsion grains can be significantly increased by forming them at elevated temperatures. A level of 22 mole % was achieved.

EXAMPLE 2

Point E2, FIG. 1

To a stirred reaction vessel containing 4l of a 5% bone gelatin solution at 35° C. and pH 5.6 were added a 4M $AgNo_3$ solution at 150 ml/min and a 4M NaCl solution at a rate needed to maintain a pAg of 7.8. The precipitation was stopped after 4 moles of $AgNO_3$ was added. The pAg was then adjusted to 8.1 with NaCl.

Portions of this emulsion were mixed with portions of a fine grain AgI emulsion as given in Table I below. (The AgI emulsion had a pAg of 10.3 and consisted of particles <0.05 μm). The mixtures (325 g) were placed in an autoclave and pressured to 689.5 kPa (100 psi) above ambient with nitrogen. With stirring, the mixtures were heated to 160° C. and held at this temperature for 15 min. They were then cooled to 40° C. requiring 3 min. The resulting emulsions were washed free of $NaNO_3$ and resuspended in 35 g of a 5% gelatin solution.

X-ray powder diffraction patterns were taken. For each emulsion, from the position of the peak of the AgICI {425} reflection, the percentage of dissolved iodide in the AgCl lattice was calculated using the equation for a(ICl) given above.

TABLE I

| Emulsion | Mole % AgI Added (% of Total Ag) | {425} Reflection 2Θ | Mole % I in AgICl Calc'd from X-ray Data | Free AgI From X-ray Data |
|---|---|---|---|---|
| A | 20.1% | 66.49° | 20.2% | none |
| B | 23.0% | 66.33° | 22.1% | Trace |

Figure 2:
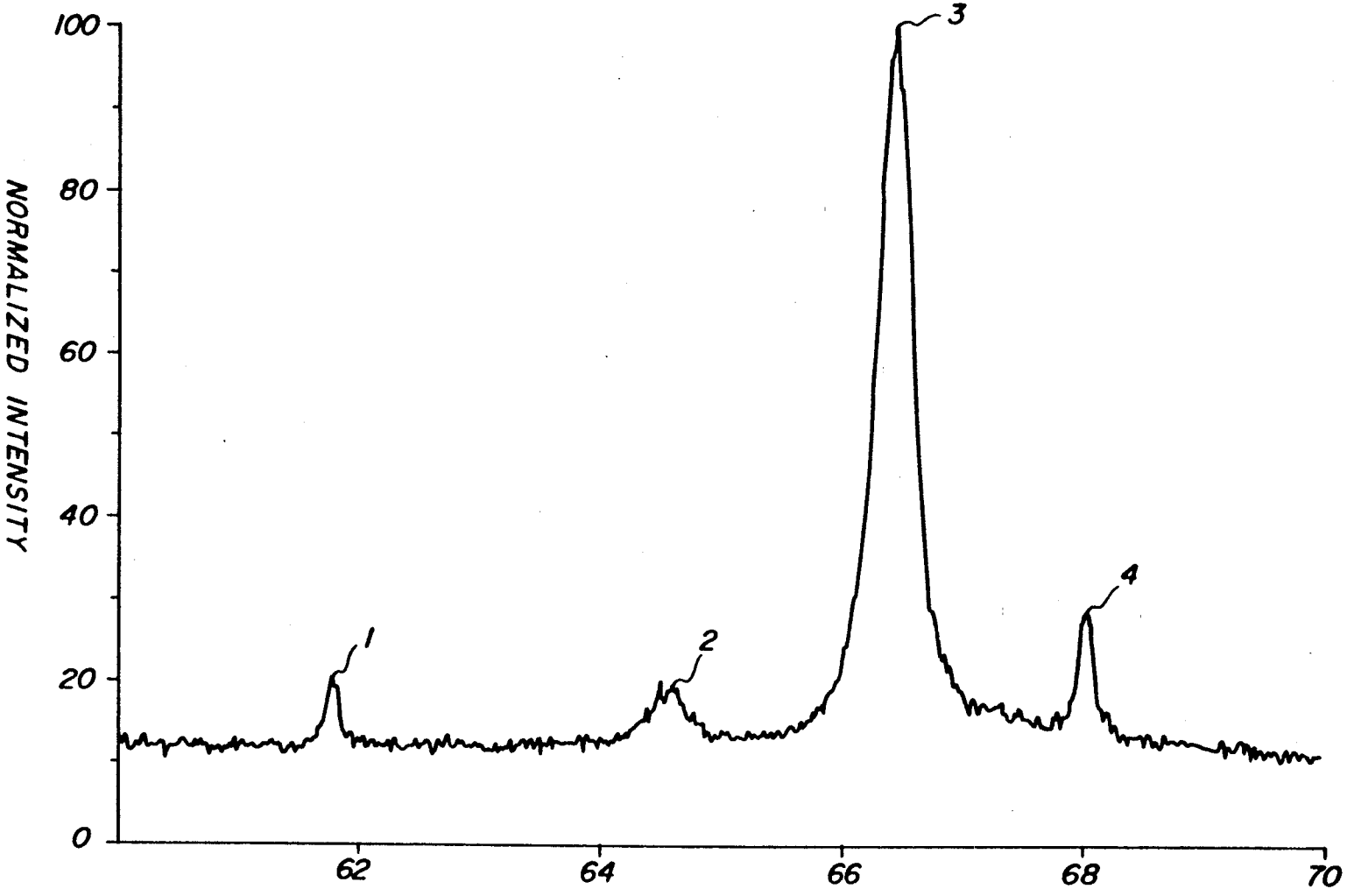
FIG. 2 is a plot of X-ray diffraction relative intensity versus scattering angle.

Note that as the amount of added iodide increased, the peak position of the {425} reflection shifted corresponding to a level of 22.1 mole % iodide dissolved in the AgICl grains. The x-ray powder diffraction pattern of Emulsion B is shown in FIG. 2, where 2Θ is the scattering angle and the highest scattering intensity has been assigned a normalized value of 100. The peaks 1 and 4 are produced by a silicon internal standard. Peak 2 is the {331} reflection, and the peak 3 is the {420} reflection. This emulsion consisted of grains having an average diameter of 0.5 μm.

EXAMPLE 3

A fine grain AgCl emulsion was made similar to that of Example 2 except that 4 L of a 10% bone gelatin solution was used and the emulsion was precipitated at 40° C. and pAg of 7.5.

An AgICl emulsion was made similar to that of Example 2B, except the mixture of AgCl and AgI emulsions was heated to 150° C. and held at this temperature for 5.0 minutes. The emulsion was cooled to 40° C. (3 minutes required) and washed by the phthalated gelatin coagulation process of H. Yutzy and F. Russell U.S. Pat. No. 2,614,929.

The resulting emulsion consisted of grains having a mean size of 0.30 μm, 95% of the grains were within the size range 0.19 μm–0.41 μm. The x-ray powder diffraction pattern of this emulsion showed the AgICl {425} diffraction peak to be centered at $2\theta=66.43°$. This peak position indicates that the grains contain 21 mole % dissolved iodide in the AgCl lattice.

EXAMPLE 4

Below Point B, FIG. 1

This example is a control. It illustrates that a maximum of 27.3 mole % iodide can be incorporated in a 1:1 AgClBr crystal phase precipitated at 90° C.

To a stirred reaction vessel containing 400 g of a 7.5 wt % bone gelatin solution made 0.10M in chloride with NaCl was added $AgNO_3$ solution (2.5M) at 2.0 ml/min and a halide ion salt solution at 2.0 ml/min. The composition of this halide ion solution is given in Table II below. Note that the NaCl compound was in excess by an amount needed to maintain a constant 0.1M chloride ion excess in the reaction vessel. The volume of silver and halide solutions consumed were the same, and a total of 0.25 mole of silver was added.

TABLE II

| Emulsion | 4A | 4B |
|---|---|---|
| Halide Ion Solution | | |
| NaCl | 1.07M | 0.95M |
| NaBr | 0.87M | 0.75M |
| NaI | 0.75M | 1.00M |
| Cl:Br:I Added (M %) | 35:35:30 | 30:30:40 |
| Scattering Angle 2Θ | 64.932° | 64.932° |
| Cl:Br:I Found (M %) | 36.4:36.4:27.3 | 36.4:36.4:27.3 |

X-ray powder diffraction analysis showed that Emulsion 4B contained two phases. One phase, containing mixed halides, was of the composition as the sole phase found in Emulsion 4A. The other phase consisted essentially of silver iodide. This analysis demonstrated that increasing the proportion of iodide present during precipitation is not capable of increasing the iodide concentration in the mixed halide phase.

EXAMPLE 5

This example gives the preparation of an AgBrClI emulsion which consists of one phase having a composition of 35.6 mole % I, 32.2 mole % Br and 32.2 mole % Cl.

A fine grain emulsion containing the desired amounts of chloride, bromide and iodide but consisting of multiple phases was prepared by the following procedure: To a stirred reaction vessel containing 4 L of a solution 10% in bond gelatin and 0.028M in NaCl at 40° C. were added a solution 4M in $AgNO_3$ at 150 ml/min and a solution 1.33M in NaCl, 1.30M in NaBr and 1.40M in NaI at a rate needed to maintain a pAg of 7.5. The total silver and halide solutions consumed were 1.00 L.

A portion of this fine grain emulsion was placed in an autoclave and pressured to 689.5 kPa (100 psi) above ambient with nitrogen. With stirring, it was heated to 160° C. and held at this temperature for 5 min. then cooled to 40° C. which required 3 min.

The resulting emulsion consisted of grains having an average diameter of 0.8 μm. The x-ray powder diffraction pattern of this emulsion showed the AgIBrCl {425} diffraction peak to be centered at $2\Theta=64.42°$ which is appropriate for a composition of 35.6 mole % I, 32.2 mole % Br and 32.2 mole % Cl.

EXAMPLE 6

Point E6, FIG. 1

This example gives the preparation of an AgBrClI emulsion which consists of a main phase of a rock salt crystal structure having a composition of 30.2 mole % Br, 30.2 mole % Cl and 39.6 mole % I and a substantially smaller amount of a silver iodide phase.

A fine grain emulsion containing multiple phases having a combined composition of 27.5 mole % Cl, 27.5 mole % Br and 45.0 mole % I was prepared by the following procedure: To a stirred reaction vessel containing 4 L of a solution 10% in bone gelatin and 0.028M in NaCl at 40° C. were added a solution 4M in $AgNO_3$ at 150 ml/min and a solution 1.16M in NaCl, 1.10M in NaBr and 1.80M in NaI at a rate needed to maintain a pAg of 7.5. The total silver and halide solutions consumed were 1.00 L.

A portion of this fine grain emulsion was placed in an autoclave and pressured to 689.5 kPa (100 psi) above ambient with nitrogen. With stirring, it was heated to 160° C. and held at this temperature for 5 min. then cooled to 40° C., which required 3 min.

The resulting emulsion consisted of grains having an average diameter of 0.7 μm. The x-ray powder diffraction pattern of this emulsion showed that it consisted of a mixed halide phase of the rock salt type crystal structure and a smaller amount of a phase consisting essentially of silver iodide. The mixed halide phase exhibited a reflection at $2\Theta=64.170°$ (full width at half peak height of 0.32°). With silver chloride and silver bromide confined to the mixed halide phase, the reflection angle indicated the mixed halide phase to consist of 30.2 mole % Cl, 30.2 mole % Br and 39.6 mole % iodide.

The invention has been described in detail with particular reference to preferred embodiments thereof, but it will be understood that variations and modifications can be effected within the spirit and scope of the invention.

What is claimed is:

1. A photographic silver halide emulsion comprised of a high chloride silver iodohalide grain structure having a face centered cubic rock salt type structure in which the proportions of chloride, bromide and iodide ions are chosen to lie within the boundary defined by A, B, C, and D in FIG. 1.

2. A photographic silver halide emulsion comprised of a high chloride silver iodohalide grain structure having a face centered cubic rock salt type crystal structure in which the proportions of chloride, bromide and iodide ions are chosen to lie within the boundary defined by A', B' C and D in FIG. 1, where A' indicates a 1 mole percent higher iodide concentration than A and B' indicates a 1 mole percent higher iodide concentration than B.

3. A photographic silver halide emulsion comprised of a high chloride silver iodohalide grain structure having a face centered cubic rock salt type crystal structure in which the proportions of chloride, bromide and iodide ions are chosen to lie within the boundary defined by A', B' C and D in FIG. 1, where A' indicates a 2 mole percent higher iodide concentration than A and B' indicates a 2 mole percent higher iodide concentration than B.

4. A photographic silver halide emulsion comprised of a high chloride silver iodohalide grain structure having a face centered cubic rock salt type crystal structure in which the proportions of chloride, bromide and iodide ions are chosen to lie within the boundary defined by A, B, E6 and E2 in FIG. 1.

5. A photographic silver halide emulsion comprised of a high chloride silver iodohalide grain structure having a face centered cubic rock salt type crystal structure in which the proportions of chloride, bromide and iodide ions are chosen to lie within the boundary defined by A', B' E6 and E2 in FIG. 1, where A' indicates a 1 mole percent higher iodide concentration than A and B' indicates a 1 mole percent higher iodide concentration than B.

6. A photographic silver halide emulsion comprised of a high chloride silver iodohalide grain structure having a face centered cubic rock salt type crystal structure in which the proportions of chloride, bromide and iodide ions are chosen to lie within the boundary defined by A', B' E6 and E2 in FIG. 1, where A' indicates a 2 mole percent higher iodide concentration than A and B' indicates a 2 mole percent higher iodide concentration than B.

7. A photographic silver halide emulsion comprised of an iodochloride grain structure having a face centered cubic rock salt type crystal structure containing from 13 to 50 mole percent iodide, based on total silver.

8. A photographic silver halide emulsion according to claim 7 in which said iodochloride grain structure contains up to 23 mole percent iodide.

9. A photographic silver halide emulsion according to claim 7 in which said iodochloride grain structure contains at least 14 mole percent iodide.

* * * * *